US010617928B1

(12) United States Patent
Rozner et al.

(10) Patent No.: US 10,617,928 B1
(45) Date of Patent: Apr. 14, 2020

(54) BOWLING VISUAL SWING TRAINING APPARATUS WITH LINE LASER

(71) Applicants: Marvin John Rozner, Wichita, KS (US); Richard Clay Steelsmith, Wichita, KS (US)

(72) Inventors: Marvin John Rozner, Wichita, KS (US); Richard Clay Steelsmith, Wichita, KS (US)

( * ) Notice: Subject to any disclaimer, the term of this patent is extended or adjusted under 35 U.S.C. 154(b) by 0 days.

(21) Appl. No.: 16/033,198

(22) Filed: Jul. 12, 2018

(51) Int. Cl.
*A63D 5/04* (2006.01)
*A63B 69/00* (2006.01)

(52) U.S. Cl.
CPC ..... *A63B 69/0046* (2013.01); *A63B 2207/02* (2013.01); *A63B 2243/0054* (2013.01)

(58) Field of Classification Search
CPC ..... A63D 1/00; A63B 69/0046; A63B 2243/0054; A63B 2207/02
USPC ..... 473/59, 61
See application file for complete search history.

(56) References Cited

U.S. PATENT DOCUMENTS 914,975 A * 3/1909 Radley ..... F21V 7/09 200/DIG. 2
4,012,629 A * 3/1977 Simms ..... A44C 15/0015 362/104
D297,172 S * 8/1988 Flohr ..... D26/39
D300,260 S * 3/1989 Segeren ..... D26/39
5,124,892 A * 6/1992 Lambert ..... B64D 11/00 362/103
5,255,167 A * 10/1993 Toussaint ..... F21L 4/06 359/354
5,632,548 A * 5/1997 Mayfarth ..... F21L 4/00 362/103
6,082,872 A * 7/2000 Ting ..... F21L 4/00 362/191
7,165,859 B1 * 1/2007 Munari ..... F21L 4/00 362/103
8,975,606 B2 * 3/2015 Bowers ..... F21L 4/00 250/504 R
2007/0147025 A1 * 6/2007 Shirey ..... A44C 9/0053 362/103
2011/0305496 A1 * 12/2011 Jolani ..... B43K 23/001 401/6
2016/0282935 A1 * 9/2016 Yang ..... G06F 3/0346

* cited by examiner

*Primary Examiner* — William M Pierce

(57) ABSTRACT

A Bowling Visual Swing Training Apparatus is disclosed. The embodiment specifically relates to training devices which assist a bowler in the development of correct and proper swing fundamentals. The embodiment utilizes laser line technology to provide an optical indication of the directional and rotational aspects of the bowling arm and hand throughout the swing as they relate to a preferred swing reference line, as a means of training and improving one's swing fundamentals and technique. The embodiment is compact in size, made of durable plastic, or other light-weight material, and is designed to be worn on a single finger, primarily, but not specifically, the index finger. The embodiment combines the laser module and its battery power pack into one compact unit, affixed to a comfortable finger plate that conforms to the user's finger, and is attached to the finger by means of elastic Velcro straps or other suitable securing means.

4 Claims, 4 Drawing Sheets

| | |
|---|---|
| 100 | Bowling Visual Swing Training Apparatus |
| 10 | Finger Plate Comfort Pad |
| 12 | Finger Plate |
| 13 | Finger Plate Recesses |
| 14 | Securing Finger Loops |
| 16 | Battery Case |
| 18 | Battery Case On/Off Switch |
| 20 | Laser Mount |
| 22 | Laser Module |
| 24 | Laser Line Alignment Wheel |
| 26 | Power Cable and Cable Wrap |
| 28 | Swing Reference Line |

| | |
|---|---|
| 100 | Bowling Visual Swing Training Apparatus |
| 10 | Finger Plate Comfort Pad |
| 12 | Finger Plate |
| 13 | Finger Plate Recesses |
| 14 | Securing Finger Loops |
| 16 | Battery Case |
| 18 | Battery Case On/Off Switch |
| 20 | Laser Mount |
| 22 | Laser Module |
| 24 | Laser Line Alignment Wheel |
| 26 | Power Cable and Cable Wrap |
| 28 | Swing Reference Line |

| 100 | Bowling Visual Swing Training Apparatus |
|---|---|
| 10 | Finger Plate Comfort Pad |
| 12 | Finger Plate |
| 13 | Finger Plate Recesses |
| 14 | Securing Finger Loops |
| 16 | Battery Case |
| 18 | Battery Case On/Off Switch |
| 20 | Laser Mount |
| 22 | Laser Module |
| 24 | Laser Line Alignment Wheel |
| 26 | Power Cable and Cable Wrap |
| 28 | Swing Reference Line |

BOWLING VISUAL SWING TRAINING APPARATUS WITH LINE LASER

CLAIM TO PRIORITY OF EARLIER FILED APPLICATION(S)

This application claims the benefit of U.S. Provisional Application No. 62/531,453 filed Jul. 12, 2017.

CROSS-REFERENCE TO EARLIER FILED APPLICATION(S)

The disclosure of U.S. Provisional Application No. 62/531,453 filed on Jul. 12, 2017 is incorporated herein by reference in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

(a) Field of the Invention

The present invention relates generally to the sport of bowling, and more particularly to training devices which assist a bowler in the development of correct and proper swing fundamentals

(b) Description of the Prior Art

Proper swing fundamentals for a bowler in the game of bowling is perhaps one of the most difficult aspects of the game to learn to repeat consistently and correctly. It is, however, perhaps one of the most important fundamentals to master in one's endeavor to improve and excel in one's performance. Proper and correct swing plane path and proper and correct hand, arm, and/or wrist rotation throughout the entirety of the bowling swing are vital aspects for establishing, maximizing and improving accuracy, consistency, ball speed, and release fundamentals. There are very few devices in the prior art that address this specific issue in the game of bowling. While other sports, such as golf, address the training of swing fundamentals through a variety of methods using various laser-based devices, there are no laser-based devices in the game of bowling that fully address the improvement of these fundamental swing related skills. In addition, many of these types of training devices in other sports, utilize a laser point to trace the swing's path. Simply using a laser point to define or reflect swing fundamentals, when related to the bowling swing, would be very limiting, as it would not address any rotational aspects of the arm, wrist and/or hand. Additionally, many prior art devices are large and bulky in scope, and do not provide a compact, portable, convenient option for everyday training, virtually anywhere.

Various devices have been proposed in the prior art. Many of these represent a means of illuminating a desired work area or general space, in a hands-free manner as in U.S. Pat. No. 8,975,606B2 by Bowers (Mar. 28, 2013). That appliance demonstrates an illuminating device designed to be worn on two fingers, while its operation and purpose is based on being an illuminating light source, not a laser-based training device for bowling. Other laser-based prior art comes in the form of a glove or wrist brace apparatus, as in US20150282539A1 by Darby (Jun. 22, 2015), which demonstrates a bowling related glove and wrist brace mounted device. This device is not only bulky and cumbersome, but it is not devised to aid in the training of swing fundamentals. It is merely a device to view and analyze the trajectory of a bowling ball via laser to describe a desired ball path trajectory on the lane from the bowler to the pins. U.S. Pat. No. 3,811,684A by Tredway (Jun. 11, 1973) demonstrates a laser-based golf swing training device. It too, is rather bulky, and is designed to be worn on a golfer's glove, which is inconvenient and cumbersome. U.S. Pat. No. 5,544,888A by Pellegrini (Aug. 4, 1995) demonstrates a golf swing plane trainer that emits a laser point, or pair of laser points, as the visual representation of the swing that assists the golfer in evaluating his/her swing characteristics. When related to a bowling device, laser points of light could be used to trace the bowler's swing plane along an intended plane line, but it would not reflect any twisting or rotational aspect of the bowler's arm, wrist, and/or hand during the swing, which is a vital aspect to efficient fundamentals in the bowling swing.

BRIEF SUMMARY OF THE INVENTION

The Bowling Visual Swing Training Apparatus relates to training devices which assist a bowler in the development of correct and proper swing fundamentals. The development of these skills requires controlled and repeatable practice, where that controlled practice exemplifies a bowling swing that represents proper form. The embodiment is a training device that utilizes line laser technology in conjunction with an established Swing Reference Line to provide an optical, linear indication of the entirety of the bowling swing plane, including pushaway, backswing, downswing, and follow through. Additionally, the line laser technology would also visually reflect any rotational movements of the arm, wrist, and/or hand throughout the entirety of the swing. When used in conjunction with the Swine Reference Line the projected, visual laser line provides the user the dual benefit of monitoring and improving both the directional and rotational aspects of the bowling arm, wrist and/or hand throughout the swing, as a means of training and improving the user's swing fundamentals and technique.

A further benefit of the embodiment is its compact and comfortable design. The embodiment combines the laser module and its battery powered pack into one compact unit that can be comfortably and conveniently worn on, but not limited to, the user's index finger, as opposed to a cumbersome unit affixed to a glove, wrist device, or multiple fingers. Other sports, such as golf, utilize laser-based swing training devices. In golf, for example, the units are mounted to the golf club shaft or grip, clubhead, or in the form of a unit that is attached to a bulky glove. The present embodiment is low in cost, simple in construction, lightweight, and easily transportable for use nearly anywhere, encouraging frequent use, and promoting the convenience of at-home swing training. The present embodiment is quite simple to use and understand, providing an inexpensive, yet high tech option for bowlers of all ages, genders and sizes seeking to improve their swing technique.

ADVANTAGES

Although some sports, such as golf, utilize laser technology for swing training specific to their sport, the Bowling Visual Swing Training Apparatus is designed for and provides the following advantages as they relate to bowling. Various embodiments of the Bowling Visual Swing Training Apparatus may have one or more of the following advantages:

- The Bowling Visual Swing Training Apparatus utilizes a laser module assembly with a lens configuration that produces a fan beam that projects a visible laser line, commonly referred to as a line laser module. This line laser module produces a visible line which may consist of any desired color, size or intensity that would produce an obvious and distinguishable visible line, contrary to a laser pointer which produces only a visible laser point. When this visible laser line is utilized with, aligned with, and traced over an accompanying and established Swing Reference Line during a simulated bowling practice swing, it will provide a complete swing plane visual reference that includes and clearly defines the desired aspects of maintaining a proper swing plane, as well as providing a visual reference that will reflect any turning or rotating of the arm, hand, and/or wrist during the swing.
- The Bowling Visual Swing Training Apparatus is easily attached to, and detached from, the bowler's finger and fits fingers of all sizes, via an attachment mechanism comprised of fully adjustable Securing Finger Loop(s) and embodiments that include variably sized Finger Plates. These Securing Finger Loops can be comprised of a variety of possible materials, including, but not limited to a velcro based material, an elastic material, or a combination of the two. Various embodiments may also include a single or a plurality of Securing Finger Loops.
- The projected laser line is easily aligned and adjusted for the differences between each bowler's unique hands and fingers through a simple turn of the Laser Line Alignment Wheel.
- The bowler is given a visually measurable and definitive representation, process, and means for training a proper and efficient swing plane, as well as minimal arm, wrist and hand rotation throughout the swing.
- The bowler is furnished with a training technique that enhances and quickens the learning process, through proper fundamental repetition, as the Bowling Visual Swing Training Apparatus trains the bowler's mind and body to perform the correct and proper fundamentals through visually guided perfect repetitions.
- The Bowling Visual Swing Training Apparatus is easy to use. It's inherent visual nature and straightforward, simplistic operation, allow even young bowlers the ability to understand and properly use the device.
- The Bowling Visual Swing Training Apparatus's portability allows the bowler the convenience of training at home, as well as at the bowling center, or in virtually any indoor or outdoor medium or low ambient light location. Convenience and portability are achieved by incorporating the use a battery cell or cells to power the embodiment. It should be known that battery power is not limited to any certain type battery cell, including, but not limited to cylindrical, rectangular, coin or button, or any of the various battery chemistry compositions and/or rechargeable or non-rechargeable types.
- The Bowling Visual Swing Training Apparatus can be used and easily understood by bowlers of all ages, genders, and sizes.
- The Bowling Visual Swing Training Apparatus is low in cost, simple in its construction, lightweight, portable, and easily transportable for use nearly anywhere. Its lightweight nature can be attributable to the durable plastic material used for its major components but is certainly not limited to plastic or any specific material.

BRIEF DESCRIPTION OF SEVERAL VIEWS OF THE DRAWINGS

We have included 5 drawings of the Bowling Visual Swing Training Apparatus.

Reference Numerals for the Components of the Bowling Visual Swing Training Apparatus.

100 Bowling Visual Swing Training Apparatus
10 Finger Plate Comfort Pad
12 Finger Plate
13 Finger Plate Recesses
14 Securing Finger Loops
16 Battery Case
18 Battery Case On/Off Power Switch
20 Laser Mount
22 Laser Module Assembly
24 Laser Line Alignment Wheel
26 Power Cable and Cable Wrap
28 Swing Reference Line

DETAILED DESCRIPTION OF THE INVENTION

In the following detailed description of the described embodiment, reference is made to the accompanying drawings. The description reflects the first example of embodiment, but it should be known that it is certainly not limited in its scope only to this first embodiment description. It would be obvious to those skilled in the art that various adaptations or changes to the materials used or sizes, shapes and colors of the embodiments can be made without departing from the essence and scope of the invention. It is therefore intended, in the accompanying claims, to cover all such changes and/or adaptations that would fall within the scope of this invention.

Figure 1:
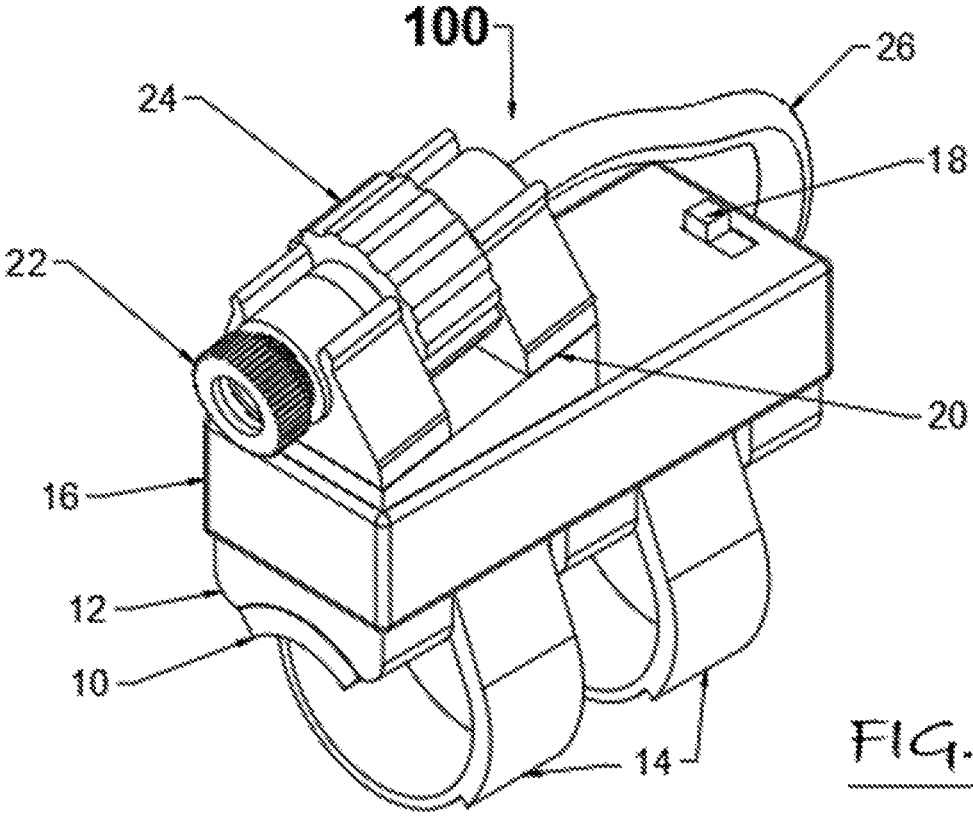
FIG. 1 depicts a perspective frontal view of the Bowling Visual Swing Training Apparatus 100.

FIG. 1 depicts a perspective frontal view of the Bowling Visual Swing Training Apparatus 100.

Figure 2:
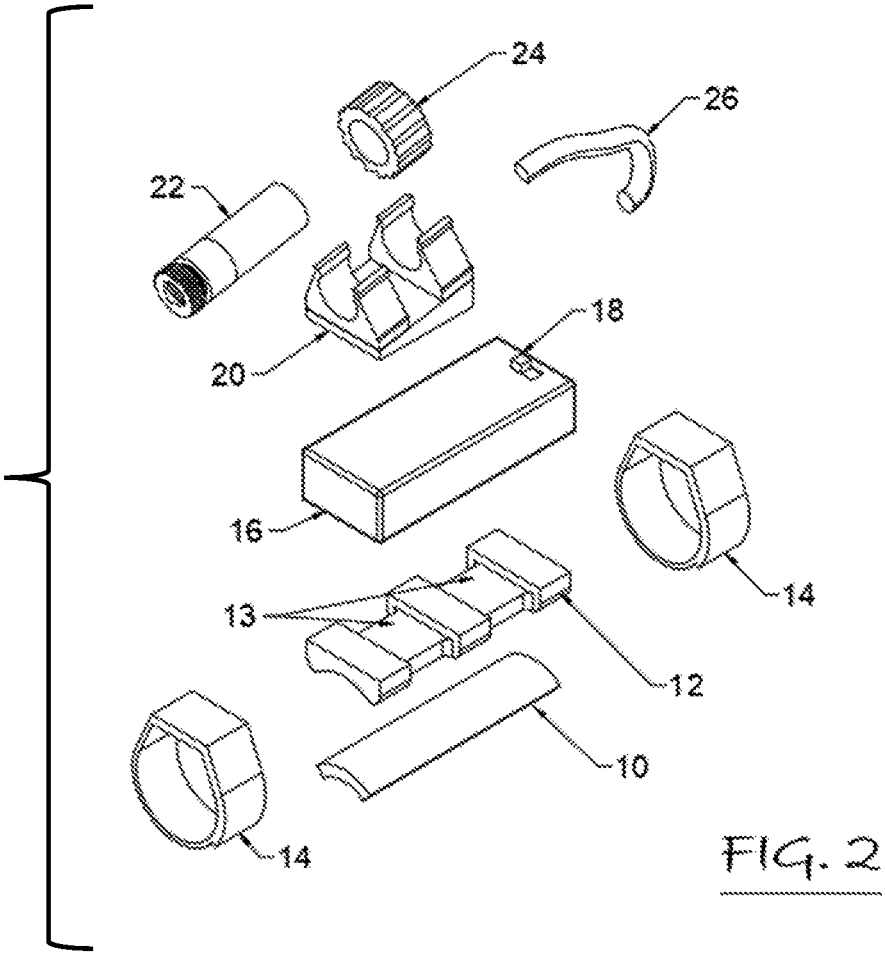
FIG. 2 is an exploded view of the major components of the Bowling Visual Swing Training Apparatus 100.

FIG. 2 is an exploded view of the Bowling Visual Swing Training Apparatus 100 and its major components, consisting of a Finger Plate Comfort Pad 10, a Finger Plate 12, Finger Plate Recesses 13, Two Securing Finger Loops 14, a Battery Case 16 with removable access cover, a Battery Case On/Off Power Switch 18, a Laser Mount 20, a Laser Module Assembly 22 that is equipped with a lens that fans out the laser beam, generating and projecting a visible laser line, a Laser Line Alignment Wheel 24, and a Power Cable and Cable Wrap 26.

The elongated, rectangular Finger Plate Comfort Pad 10 is comprised of a soft foam material and is adhered to the underneath side of the similarly sized Finger Plate 12. A Finger Plate 12 is rectangular in its general shape, is made of a durable, lightweight plastic, and features a concave underside, designed to contour to a shape resembling the shape of the bowler's finger for comfort. The Finger Plate 12 incorporates two Finger Plate Recesses 13, one for each of the two Securing Finger Loops 14. The Securing Finger Loops 14 are made of Velcro, elastic, or an elastic Velcro combination, and thread through the Finger Plate Recesses 13 to fit securely between the top face of the Finger Plate 12 and the removable access cover on the bottom face of the Battery Case 16. The Battery Case 16 is comprised of a durable, lightweight plastic material and has a removable battery access cover on its bottom face which is aligned with and adhered or attached to the top face of the Finger Plate 12. The Battery Case 16 internally encloses two batteries, which provide a power source, and are accessed by disengaging the removable battery access cover on its bottom face. A Battery Case On/Off Power Switch 18 is located on the top face of the Battery Case 16 and is situated near the rear of that face. The Battery Case On/Off Switch 18 conveniently controls the circuit which relays the batteries' power to the Laser Module Assembly 22, via the proper circuit hardware and a Power Cable and Cable Wrap 26 connection. A Laser Mount 20 is comprised of a durable, lightweight plastic material. The outer edges of the underside of the Laser Mount 20 are aligned with and securely bonded to the outer edges of the front portion of the top face of the Battery Case 16. (Insert revision paragraph (2) here) A Laser Module Assembly 22 is a manufactured laser line generator module assembly that is readily available for purchase to the general public. This Laser Module Assembly 22 is comprised of an outer housing, a laser diode, a drive circuit and a glass lens optics which enables the module to project a visible line, as opposed to the type of laser assembly which would project a visible laser point. The Laser Module Assembly 22 incorporates a focusable, cylindrical glass lens through which the laser light or beam passes. The cylindrical glass lens then fans the projected beam out, creating a fan beam which generates a viewable and visible laser line on a projected surface. This type of laser module assembly is commonly referred to as a line laser. Differing line laser modules are available in either adjustable or fixed fan angles and are also commonly available in various laser colors, such as red, green or violet. Fixed fan angle assemblies should project a fan angle of at least 60-120 degrees to produce a laser line of the length required for optimum visual feedback as it relates to the Swing Reference Line 28 for the purpose of bowling swing training. For this embodiment, the outer housing utilized is cylindrical in overall shape, and is 12 mm×35 mm in outer width and length dimensions. The Laser Module Assembly 22 is certainly not limited to these exacting characteristics, this is the simply the size that was used for the preferred embodiment. However, an outer housing dimension in this size range should be utilized and is recommended, as this compact size is necessary to satisfy the inherent compact nature of the overall Bowling Visual Swing Training Apparatus 100 as it fits over a human finger. It is vital, however, to the integrity of the invention, that the generated laser from the Laser Module Assembly 22 is one that utilizes a lens that produces a fan beam that projects a visible line and not of a module that produces a visible point, as in a laser pointer. The width of the laser line emitted may vary slightly but need only produce a line width that is easily visible to the user to provide optimum visual feedback. The Laser Module Assembly 22 snaps securely and non-permanently into the similarly sized opening in the top of the Laser Mount 20, with its lens end facing the front, forward-most side of the Bowling Visual Swing Training Apparatus 100. A Laser Line Alignment Wheel 24 is comprised of a durable, lightweight plastic material and may be produced through 3d printing or any other feasible means. The circumference of the opening in the center of the Laser Line Alignment Wheel 24 is sized and shaped to correspond to the cylindrical outer shape and circumference of the Laser Module Assembly 22, of which it encompasses when assembled. The outer circumferential surface of the Laser Line Alignment Wheel 24 is comprised of small ridges or protrusions that provide a gripping surface for ease in rotating. For assembly, the Laser Line Alignment Wheel 24 is placed over the outer housing of the Laser Module Assembly 22 to its lengthwise midpoint and is securely bonded in place. The Laser Module Assembly 22, with its accompanying Laser Line Alignment Wheel 24, snaps securely and non-permanently into the similarly sized opening in the top of the Laser Mount 20, with its lens end facing the front, forwardmost side of the Bowling Visual Swing Training Apparatus 100. The Laser Module Assembly 22 is free to rotate within the inner walls of the Laser Mount 20 when the Laser Line Alignment Wheel 24 is rotated in either direction. Rotating the Laser Line Alignment Wheel 24 in turn rotates the Laser Module Assembly 22 within the inner walls of the Laser Mount 20, thus rotating the generated visible laser line in the corresponding direction. The Laser Line Alignment Wheel 24 will rarely, if ever, need to be turned more than one quarter of a turn.

Figure 3:
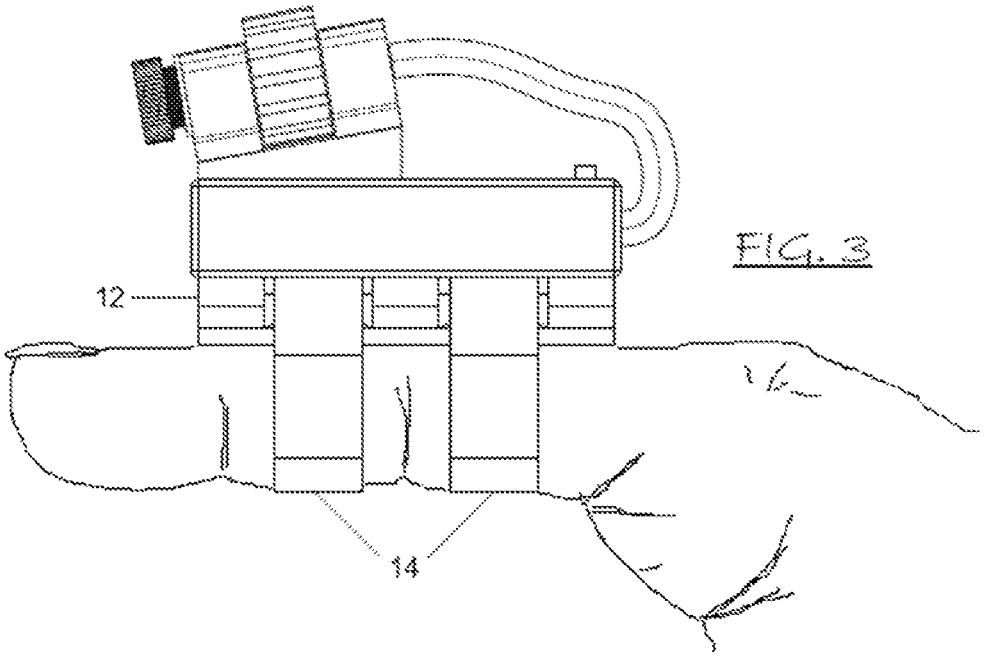
FIG. 3 shows the Bowling Visual Swing Training Apparatus 100 and how it would be secured and worn on the bowler's index finger.

FIG. 3 shows how the Bowling Visual Swing Training Apparatus 100 is attached and secured to the bowler's index finger by means of an attachment mechanism comprised of two Securing Finger Loops 14. These Securing Finger Loops 14 are threaded through the Finger Plate Recesses 13 to fit securely between the top face of the Finger Plate 12 and the removable access cover on the bottom face of the Battery Case 16 and are connected to the Finger Plate 12 in a specific manner as to allow the ends of each Loop to be wrapped and secured around the bowler's index finger, providing a secure, adjustable and comfortable fit.

Figure 4:
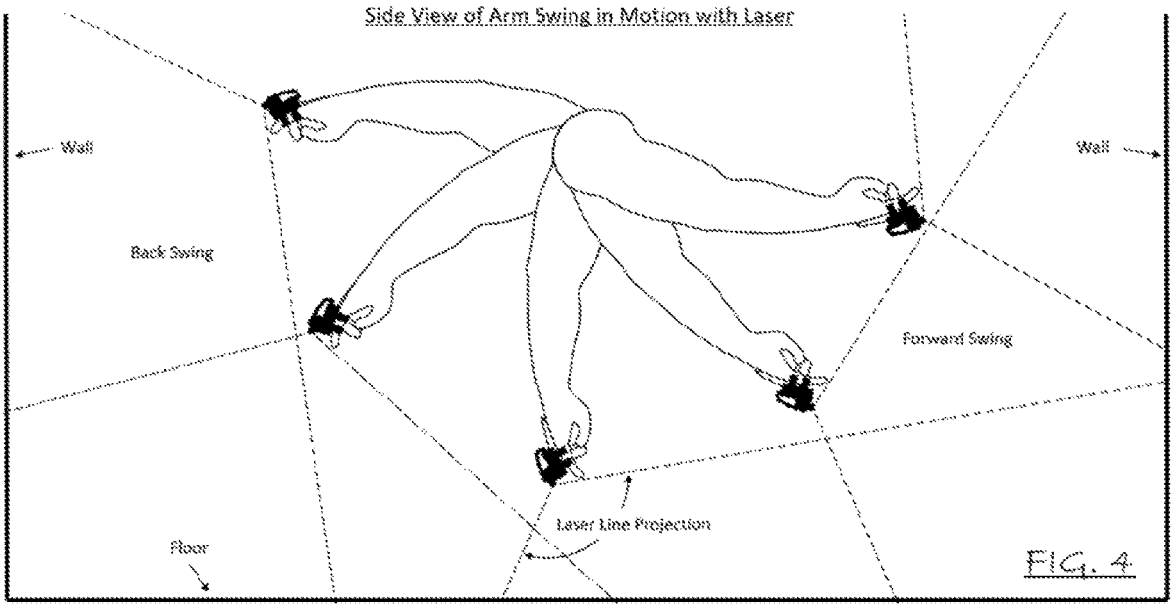
FIG. 4 shows a side view of how the Bowling Visual Swing Training Apparatus 100 will project a laser line for the bowler's swing plane reference

FIG. 4 shows a side view of how the Bowling Visual Swing Training Apparatus 100 and its projected visible laser line would work in a training scenario as the bowling armswing is in motion. Its projected visible laser line would follow in accordance with the forward and backward swinging motion of the arm. In a fundamentally proper bowling armswing, the visible laser line would correspondingly trace over the established Swing Reference Line 28 and project and reflect off of the corresponding floor and wall sections in front of, next to, and behind the user. This side view is included to provide a visual picture of the fanned laser line and how it would operate in conjunction with the armswing movement in a normal bowling swing motion.

Figure 5:
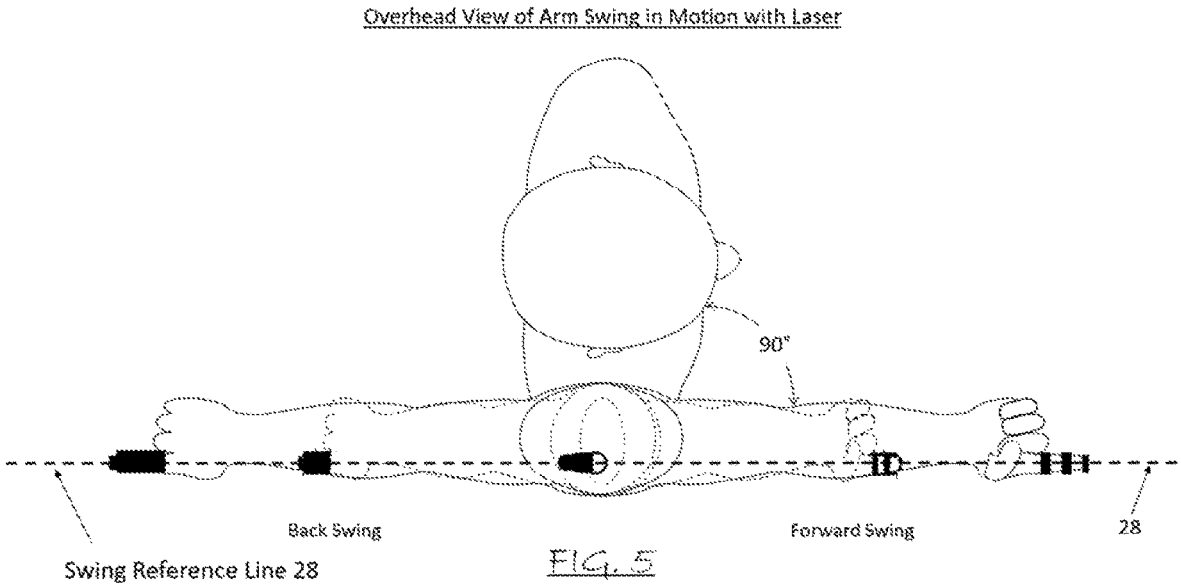
FIG. 5 shows an overhead view of how the Bowling Visual Swing Training Apparatus 100 will project a laser line for the bowler's swing plane reference along a predetermined Swing Reference Line 28.

FIG. 5 shows a top view of how the Bowling Visual Swing Training Apparatus 100 and its projected visible laser line would work in a training scenario as the bowling armswing is in motion. Most importantly it indicates the alignment of the projected visible laser line as it traces over the Swing Reference Line 28 as the bowling armswing is in motion. In a proper, fundamentally correct bowling armswing, the projected visible laser line would trace the Swing Reference Line 28 during the entirety of the backward and forward swinging motion of the armswing. Any deviations of the bowling armswing or turning of the bowling hand, wrist, or arm during the bowling armswing would be reflected in the projected visible laser line separating from its alignment and tracing motion of the Swing Reference Line 28.

Operation:

To efficiently train a bowler in the development of correct and proper swing fundamentals, a Bowling Visual Swing Training Apparatus 100 has been devised and is depicted in FIG. 1. The Bowling Visual Swing Training Apparatus 100 is compact in size, and primarily designed to be worn on the bowler's index finger of his or her bowling hand as shown in FIG. 3. It is not, however, limited to the index finger, as it may be worn on the thumb or any other digit of the hand. In addition, longer securing straps can be substituted, making it possible to be worn on the bowler's wrist, or back of the hand, as well, but would not be the preferred method.

The user would first disengage the removable cover from the Battery Case 16 by sliding it off the unit. The user would next install two batteries into the battery slots in the correct facing polarity position as indicated by the "+" and "–" markings and would then reinstall the removable cover by sliding it back onto the Battery Case 16. Paying special attention to orient the laser lens end of the Laser Module Assembly 22 forward, towards the fingernail end of their finger, the user would then continue by attaching the Bowling Visual Swing Training Apparatus 100 to the upper side of the index finger of their bowling hand by wrapping the two Securing Finger Loops 14 around the index finger as shown in FIG. 3. The next step would be to push the Battery Case On/Off Power Switch 18 into the "on" position, thus illuminating the laser line.

The user will then locate, establish, and position a straight Swing Reference Line 28 on the floor, and will position himself immediately adjacent to that line, so that it is positioned just below his bowling hand as his arm hangs down in a relaxed manner. The Swing Reference Line 28 is an integral component to the proper operational integrity of the apparatus in training proper bowling swing fundamentals. This Swing Reference Line 28 is to be used as a directional guide to be traced with the generated visible laser line projected by the Bowling Visual Swing Training Apparatus 100 throughout the entirety of the user's practice bowling armswing. The straight Swing Reference Line 28 could consist of any number of means, including, but not restricted to: A line in the carpet or along the boards of a wooden floor; a door jamb or vertical line in wallpaper; a stretched and straightened section of string, yarn or rope; a retractable swing path target line device (tape measure or similar device); removable masking tape or similar tape; or a specially designed laser based swing path target line unit that would cast a laser projected swing reference line both forward and rearward of the user.

Once the user is positioned adjacent to the Swing Reference Line 28, any number of postures may be assumed when preparing to operate the Bowling Visual Swing Training Apparatus 100. The user could assume their bowling setup position, finish position, a normal standing posture, or coordinate a combination of these during the swing training process, just to name a few.

After assuming the desired posture, the user will let the arm hang in a relaxed position at his side with the index finger and attached Bowling Visual Swing Training Apparatus 100 pointing to the floor immediately adjacent to his bowling arm side foot. The Bowling Visual Swing Training Apparatus 100 will project a visible laser line onto the floor next to the foot, as shown in FIG. 4 and FIG. 5. The user can adjust the alignment of the visible laser line by turning the Laser Line Alignment Wheel 24 slightly in either direction, which in turn rotates the Laser Module Assembly 22 within the construct of the Laser Mount 20, until the projected visible laser line is aligned directly over and traces the previously established Swing Reference Line 28. The user would then begin to slowly swing the arm back and forward in a bowling motion, taking care to trace the Swing Reference Line 28 with the projected visible laser line from the Bowling Visual Swing Training Apparatus 100. The user should continue with numerous repetitions of the practice bowling swing, continuing to focus on tracing the Swing Reference Line 28 with the projected visible laser line. A straight, proper, and fundamentally desired swing will result when the projected visible laser line perfectly traces the previously established Swing Reference Line 28. Additionally, any turning of the arm, hand, and/or wrist will result in the visible laser line turning away from its aligned position with the Swing Reference Line 28 and would become immediately apparent to the user. The more traced repetitions, the more the user begins to feel the arm swing occur in the fundamentally proper straight plane, while at the same time feeling a limited amount of rotation of the arm, hand, and/or wrist throughout the swing. Over time, and through many repetitions of the fundamentally desired swing plane and arm, hand, and/or wrist rotation, the user will begin to train their body and brain to feel the proper, desired, and efficient technique. Ultimately, the swing thoughts and feel attained during this practice will then transfer to the bowler's approach and release while bowling.

Upon completion of the user's training session, the unit should be shut off by sliding the device's Battery Case On/Off Power Switch 18 into the marked "off" position. The Bowling Visual Swing Training Apparatus 100 can then be removed from the index finger by releasing the Securing Finger Loops 14 from their secured position.

Alternative Materials of the Embodiment

The materials used for the embodiment are not limited to any certain types of durable plastic or any other material for that matter. Any lightweight material may be used for the individual components of the embodiment, such as, but not limited to, aluminum or any metallic-based material, carbon fiber, or any wood-based material without departing from the scope of the invention. The same would hold true for the Securing Finger Loops, as they could easily be comprised of a multitude of materials without departing from the scope of the invention.

Alternative Operation of the Embodiment

The embodiment is not limited to wearing the device only on the index finger of the bowling hand, although it is the primary use and method of the invention. The device may be worn on the thumb, or any other finger of the bowling hand, in addition to substituting and utilizing larger securing straps and attaching to the wrist or the back of the bowling hand.

The invention claimed is:

1. A visual bowling swing training apparatus comprising:

a) a line laser module assembly b) a power supply coupled to said line laser module assembly c) a case having i) a top face ii) a bottom face d) securing finger loops e) wherein said power supply is configured to provide electricity to said line laser module assembly f) wherein said securing finger loops are attached to said bottom face of said case g) a laser line alignment wheel h) wherein said laser line alignment wheel is attached to an outer surface of said line laser module assembly i) wherein said line laser module assembly is adjustable by the laser line alignment wheel j) a laser mount k) wherein said line laser module assembly fits into said laser mount and is free to rotate within its constraints l) wherein said laser mount and said line laser module assembly are attached to said top face of said case.

2. The device of claim 1, wherein said case is comprised of a plastic material.

3. The device of claim 1, wherein said securing finger loops are comprised of hook and loop fastening material, an elastic material, or a combination of the two.

4. The device of claim 1, further comprising a switch mounted between said power supply and said line laser module assembly, wherein said switch connects or disconnects electrical current flow from said power supply to said line laser module assembly.

* * * * *